United States Patent [19]

Eckert et al.

[11] 4,170,976

[45] Oct. 16, 1979

[54] CONTROL DEVICE FOR DIESEL-INJECTION INTERNAL COMBUSTION ENGINES

[75] Inventors: Konrad Eckert, Stuttgart; Sieghart Maier, Gerlingen; Ernst Ritter, Stuttgart, all of Fed. Rep. of Germany

[73] Assignee: Robert Bosch GmbH, Stuttgart, Fed. Rep. of Germany

[21] Appl. No.: 890,161

[22] Filed: Mar. 27, 1978

[30] Foreign Application Priority Data

Mar. 29, 1977 [DE] Fed. Rep. of Germany ..... 2713805

[51] Int. Cl.[2] ..... F02D 1/04; F02M 7/12

[52] U.S. Cl. ..... 123/140 FG; 123/140 MC; 123/119 R

[58] Field of Search .... 123/140 FG, 140 R, 140 MC, 123/139 E, 119 R, 32 EA

[56] References Cited

U.S. PATENT DOCUMENTS

| | | | |
|---|---|---|---|
| 3,143,104 | 8/1964 | Cummins et al. | 123/140 FG |
| 3,385,276 | 5/1968 | Reiners et al. | 123/140 FG |
| 3,724,430 | 4/1973 | Adler | 123/119 R |
| 3,724,436 | 4/1973 | Nagata et al. | 123/140 MC |
| 3,851,635 | 12/1974 | Murtin et al. | 123/139 E |

FOREIGN PATENT DOCUMENTS

| | | | |
|---|---|---|---|
| 1246641 | 9/1971 | United Kingdom | 123/139 ST |

*Primary Examiner*—Charles J. Myhre
*Assistant Examiner*—P. S. Lall
*Attorney, Agent, or Firm*—Edwin E. Greigg

[57] ABSTRACT

A control device for diesel-injection internal combustion engines, whose hydraulically activated adjusting member moves the regulating rod of the fuel injection pump in the "stop" direction when the discharge of the hydraulic medium is blocked by a magnetic valve, and simultaneously serves as an arbitrarily engageable full-load or delivery rate reducing stop for the regulating rod. The control device includes a first electromagnet, which activates the valve member of the magnetic valve, and a second electromagnet, whose control member limits the adjusting movement of the adjusting member, which can be controlled by the valve member of the first electromagnet, to a position that serves as the full-load or lower rate stop for the regulating rod of the injection pump, when the second electromagnet is engaged. This limitation takes place mechanically or by opening a return line, which determines the position of an adjusting piston that is connected with the adjusting member.

15 Claims, 6 Drawing Figures

CONTROL DEVICE FOR DIESEL-INJECTION INTERNAL COMBUSTION ENGINES

BACKGROUND OF THE INVENTION

The invention relates to a control device for diesel-injection internal combustion engines provided with a magnetic valve, which determines the zero position of the delivery rate adjusting member of the injection pump, and which when disengaged blocks the discharge of a hydraulic medium, that is subjected to the delivery pump pressure, from a loading chamber of an adjusting member, which in turn can be moved by the pressure of this medium, to an unpressurized chamber by means of a valve member. This last named valve member can be activated by an electromagnet, whereby the hydraulic medium that is delivered from the delivery pump (preferably the fuel that is delivered from the fuel pump that supplies the injection pump) moves the adjusting member toward its stop position, which determines the zero position of the delivery rate adjusting member, against the force of return means.

One such control device already known has an adjusting member that moves the regulating rod out of its position that controls the maximum fuel delivery rate into its zero position under the pressure of the fuel, which is flowing back from the injection pump and is blocked from being discharged by the magnetic valve. The position assumed by the adjusting member when the magnetic valve is not operational determines either the starting position or the full-load position of the injection pump regulating rod, which serves as the delivery rate adjusting member, and can be moved out of this position only into the stop position; an intermediate position cannot be attained.

Fuel injection pumps are also known in which in addition to a control device that determines the starting delivery rate and stop position, an electromagnetically activatable lower delivery rate stop engages the regulator of the injection pump by proper activating elements, and presses the regulating rod back out of the full-load position into the desired lower delivery rate position. This type of additional device is very expensive to manufacture, may not prevent or hinder the deregulating movement of the control device, and requires a special production of the associated rpm regulator.

OBJECT AND SUMMARY OF THE INVENTION

The control device according to the present invention has as one of its objects, that in addition to the starting, i.e., full-load and stop positions of the regulating rod, an intermediate position of the adjusting member can be set, which serves either as a full-load or lower delivery rate stop for the delivery rate adjusting member of the injection pump. Because the control member of the second electromagnet also acts on the adjusting member of the control device, no additional structural elements are necessary, and a compact construction is possible. The function and construction of the associated rpm regulator is not influenced or limited in any way by the addition of this control device to the side of the fuel injection pump opposite the rpm regulator.

Another object of the present invention is to be able to attain an inexpensive and universally applicable control device with an adjusting member that is provided with an adjusting piston, by means of a stop slide, which cooperates directly with a stop edge on the outer surface of the adjusting piston.

In a still further advantageous object of the invention, the control member of the second electromagnet, which control member is formed as a valve member, is arranged to block the flow cross section of a return line, which opens into the wall of the loading chamber. This chamber also encloses an adjusting piston, which in turn is connected with the adjusting member. Precisely where the aforesaid opening is located, together with a control edge that is provided on the adjusting piston, determines the full-load or lower delivery rate position of the adjusting piston, and by means of a cylinder sleeve, which is longitudinally adjustable within the housing of the device, and which includes the loading chamber of the adjusting piston, the intermediate position of the adjusting piston can be set very precisely and without it being necessary to go through a plurality of steps to do so.

The invention will be better understood as well as further objects and advantages thereof become more apparent from the ensuing detailed description of four exemplary embodiments taken in conjunction with the drawings.

DESCRIPTION OF THE PREFERRED EMBODIMENTS

Figure 1:
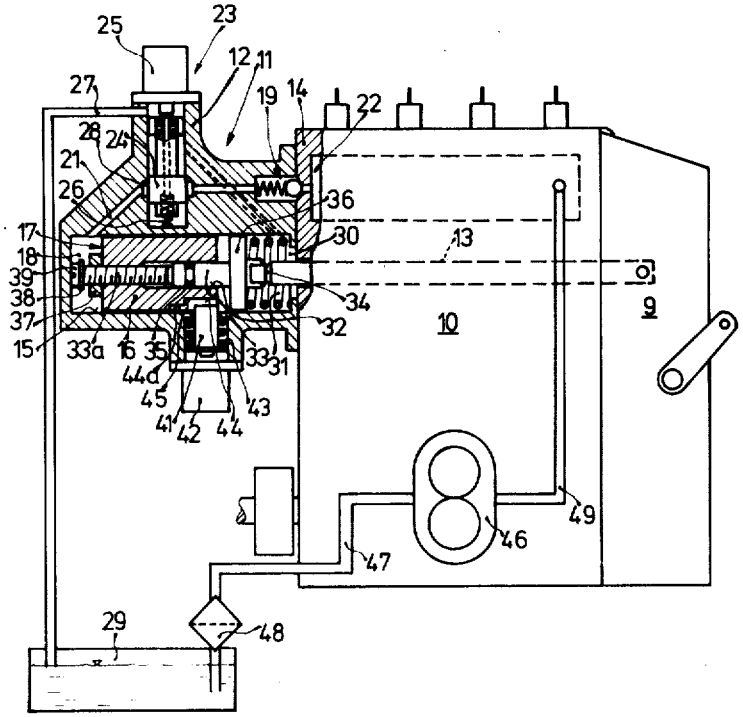
FIG. 1 shows in a cross-sectional view a simplified representation of a first exemplary embodiment of the control device according to the invention and the fuel injection pump to which it is attached being shown generally in elevation.

The first exemplary embodiment of this invention, shown in FIG. 1, discloses, generally in cross section, a control device 11, which is mounted on an injection pump 10. The control device includes a housing 12 that is fastened in any suitable manner onto the front of the housing 14 of the injection pump 10 at the same level as the delivery rate adjusting member of the fuel injection pump and encloses an adjusting piston 16 of an adjustable member 17 in a cylindrical bore 15. The adjusting piston 16 acts as a movable wall defining at the front of said control device 11 a loading chamber 18, which is formed by a portion of the cylindrical bore 15 and which is acted upon by the pressure of the fuel the latter arranged to serve as the hydraulic medium. Fuel flows out of the suction chamber 22 of the injection pump toward the loading chamber 18 through an overflow valve 19 and a feed line 21. A magnetic valve indicated generally at 23 and located in the feed line 21 has a control slide means 24 which serves as a valve member, and which in the shown, flow-less condition of a first electromagnet 25 functions together with a return spring 26 to block the connection of the feed line 21 with a return line 27. When the electromagnet 25 is engaged, the control slide 24 is moved downward against the force of the return spring 26 and thus opens an annular groove 28 so that the feed line 21 is connected by means of the return line 27 with a tank 29 which serves as the depressurized chamber for the entire device. In the position of the control slide 24 shown in FIG. 1, both the overflowing fuel from the suction chamber 22 of the injection pump 10 and the fuel that is located in the loading chamber 18, flow off to the tank 29, and a pressure spring 31 which serves as a return means supported on the housing 12 of the control device 11 moves the adjustable member 17 into its extreme left position, as shown, which thereby allows the greatest possible stroke of the regulating rod 13. This position is maintained by the adjustable member 17 when the engine is not running and when the injection pump 10 is depressurized.

A stop bolt 33 securely mounted in a bore 32 of the adjusting piston 16 is arranged with its frontal surface 34 opposite to the loading chamber 18 and thus serves as a stop for the regulating rod 13 of the injection pump 10. By means of an O-type sealing ring 35, which is placed in an annular groove of the stop bolt 33, bore 32 in the adjusting piston 16 and thereby the loading chamber 18 are sealed relative to the spring chamber 30, which encloses the pressure spring 31. This stop bolt 33 is also provided with an annular plate member 36 which serves as a resisting support for the pressure spring 31. The stop bolt 33 is threadedly secured into the adjusting piston 16 by means of a threaded portion **33*a* so as to be adjustable within a limited range and is secured in any predetermined set position by a lock nut 37. The range of adjustment of the stop bolt 33 relative to the adjusting piston 16 is determined on one end by the distance between the adjusting piston 16 and the spring plate member 36 which is formed as a travel limiting means and on the other hand by a disc 38 attached on the end of the threaded portion 33*a* and thus also serves as a limiting element. The disc 38 is attached on the end of the threaded portion 33*a* of the stop bolt 33 by a screw 39**.

A stop slide 41 that serves as a control member of a second electromagnet 42 is mounted in the housing 12 at a right angle to the longitudinal axis of the adjusting piston 16 against the return force of a spring 43, so as to be adjustable. This stop slide 41 can also be activated against the force of the spring 43 by the electromagnet 42, and when the second magnet 42 is not engaged projects into a flat grooved portion **44*a* of a recess 44 that is formed as a longitudinal groove, said grooved portion 44*a* being extended toward the loading chamber 18. In the position shown in FIG. 1, the stop slide 41 serves as a rotation preventing element for the adjusting piston 16, when the electromagnet 42 is not engaged. When the electromagnet 42 is engaged, however, the stop slide 41 is pressed against the force of the spring 43 deeper into the longitudinal groove 44, and cooperates with a stop edge 45 of the longitudinal groove 44 which is machined into the outer surface of the adjusting piston 16. This stop edge 45 is located at the point of transition from the longitudinal groove 44 to its flat groove portion 44*a*, and serves together with the stop slide 41 as a lower delivery rate limiting stop, when the adjusting piston 16 is pushed against the force of the pressure spring 31 by the abutment of the stop edge 45 on the control slide 41 during the period that the loading chamber 18 is placed under fuel delivery pressure, thus producing an adjusting movement, so that the frontal surface 34 of the stop bolt 33 prevents a movement of the regulating rod 13** beyond the thus predetermined position.

This lower delivery rate stop, which is basically formed by the control slide 41, the electromagnet 42 and the stop edge 45, can also be formed as a full-load stop, if the governor of the injection pump 10 has no means for limiting the full-load position.

The fuel injection pump 10 is equipped with a delivery pump 46, which aspirates fuel out of the tank 29 when the injection pump is running, and draws it through a suction line 47 and a filter 48 before delivering it through a supply line 49 into the suction chamber 22.

Figure 2:
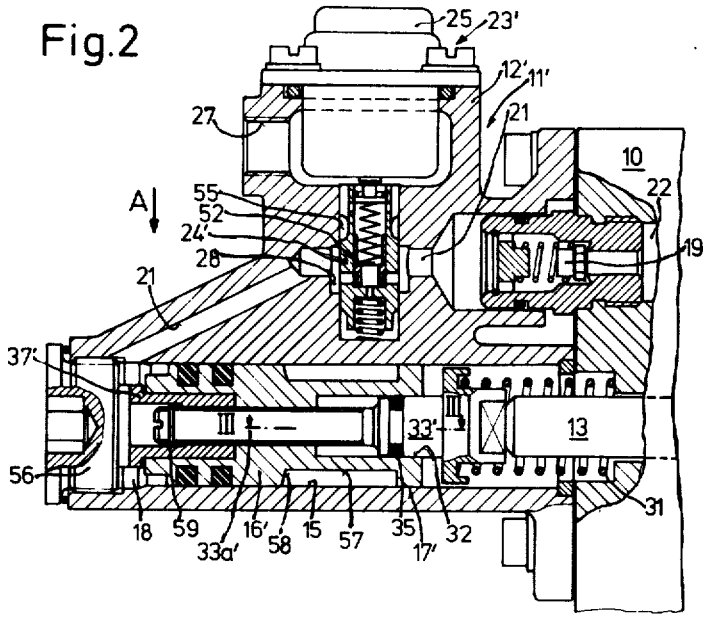
FIG. 2 shows a cross-sectional view of the second exemplary embodiment of the invention.
Figure 3:
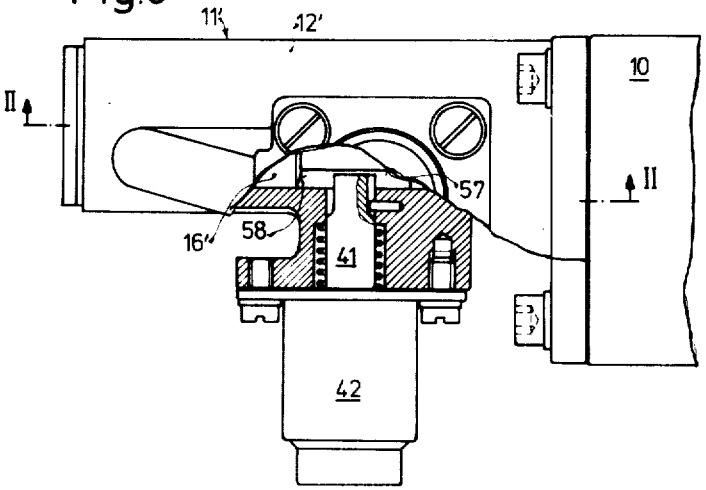
FIG. 3 is a top plan view of the second exemplary embodiment of the invention according to FIG. 2 which also shows a fragmentary cross-sectional view of one of the electromagnets.
Figure 4:
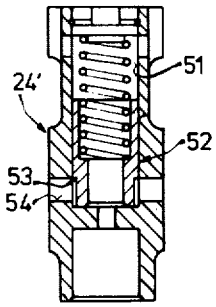
FIG. 4 shows an enlarged cross-sectional view of the valve member shown in FIG. 2.

The second exemplary embodiment of a control device, indicated generally at 11', is shown in FIGS. 2 through 4, and represents a practical exemplary embodiment of the control device 11, which is shown in a simplified form in FIG. 1. Equivalent elements are therefore given the same reference numerals, and elements that are deviants therefrom are provided with an index mark.

Thus varying from the slide valve 24 of the first exemplary embodiment according to FIG. 1, a slide valve of the control device 11' contains in a longitudinal bore 51 thereof, a safety and overflow valve 52, which in every position of the slide valve 24' is subject to the fuel delivery pump pressure which flows out of the suction chamber 22 of the injection pump 10 through the overflow valve 19 and into the feed line 21, the surface that is subject to said pressure being the annular pressure surface 53. This pressure surface 53 is connected with the annular groove 28 by means of bores 54 in the wall of the slide valve 24', which annular groove 28 is machined into a housing bore 55 of the housing 12' of the control device 11', said housing bore 55 being adapted to contain the slide valve 24'. The annular groove 28 thus is understood to be a part of the feed line 21.

The loading chamber 18, which is slightly enlarged, is formed as a portion of the cylindrical bore 15, is closed, and sealed toward the outside by a closing cap screw 56, and the adjusting member 17' has an adjusting piston 16', in whose circumference is machined an annular groove 57, which serves as a recess. The end of this annular groove 57 that is toward the loading chamber 18 forms a stop edge 58, which together with the stop slide 41 of the second electromagnet 42, serves as a lower delivery rate stop (see in this regard FIG. 3).

A stop bolt 33' is threaded into the adjusting piston 16' and carries a split ring 59 on the end of its threaded portion **33*a*' and this functions as a limiting element for the relative changes of position between the stop bolt 33' and the adjusting piston 16'. A lock nut 37', which secures the set position of the stop bolt 33' in the adjusting piston 16', is formed as a ring nut and is subject to the force of the pressure spring 31 and thereby urged against the locking cap screw 56** in the position shown.

Deviating from the position shown in FIG. 1, the stop slide 41 in FIG. 3 is in the position which it assumes when the seccond electromagnet is engaged. The slide thus projects into the recess 57 and limits the stroke of the adjusting piston 16', when the loading chamber 18 is pressurized, to a path after completion of which the adjusting member 17' seves as a lower delivery rate stop for the regulating rod 13 of the injection pump 10.

Figure 5:
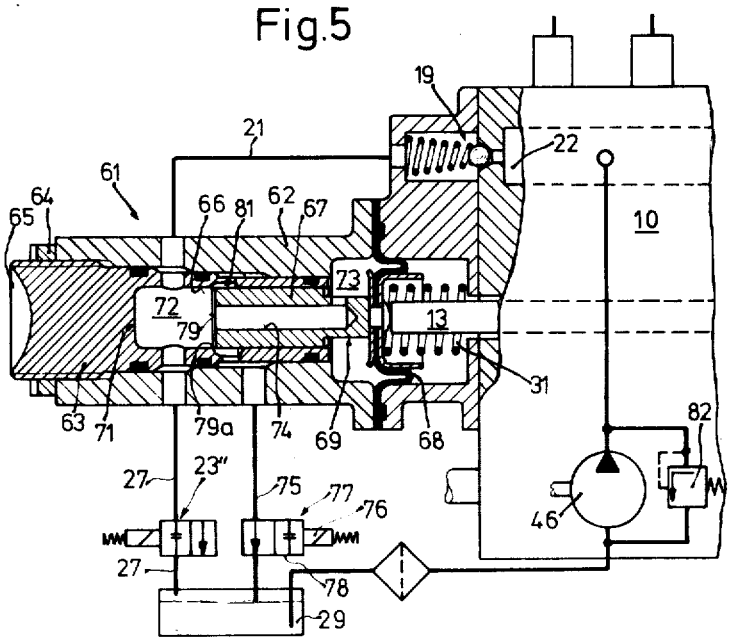
FIG. 5 shows a longitudinal sectional view through the third exemplary embodiment of the invention with a simplified representation of the injection pump and associated magnetic valves.

The third exemplary embodiment shown in FIG. 5 comprises a control device 61, which is built onto the front of the fuel injection pump 10 and encloses a cylindrical bushing 63 in the housing 62. This cylindrical bushing 63 is on the same axis as the regulating rod 13 of the injection pump 10 and is adjustable in the direction of the longitudinal axis thereof. Also, this cylindrical bushing 63 is threaded into the housing 62 and can be set in a definite position by a lock nut 64, which serves as a securing means. The cylindrical bushing 63 which projects beyond the housing 62 is provided with a concave depression 65 that is machined into its outer surface. This cavity 65 serves as the point of engagement for an adjusting tool. The cylindrical bushing 63 encloses an adjusting piston 67 in a cylindrical bore 66, which adjusting piston 67, together with an adjusting diaphragm 68, is part of an adjusting member 69. Contrary to the two exemplary embodiments previously described in connection with the FIGS. 1 through 4, in the third exemplary embodiment according to FIG. 5, the loading chamber 71 of the adjusting member 69 is formed in two sections, consisting of a piston chamber 72 and a diaphragm chamber 73, which are interconnected by a bore 74 provided within the adjusting piston 67. Fuel is delivered to the loading chamber 71 through the feed line 21 that leads out of the suction chamber 22 of the injection pump 10 and through the overflow valve 19. The fuel then acts upon the adjusting member 69, when, as shown in FIG. 5, the simplified magnetic valve 23" prevents the flow of the fuel out of the loading chamber 71 through the outflow line 27 to the tank 29.

A second magnetic valve 77, which is provided with a second electromagnet 76, is included in a return line 75. This magnetic valve 77 has a valve member 78, which serves as a control member, and can be moved by electromagnets 76 in the sense of an opening of the flow cross section of the return line 75. In FIG. 5 this valve member 78 is shown in its position holding the return line 75 open, which it assumes when the electromagnet 76 is engaged. When the outflow line 27 is being held closed by the magnetic valve 23", the fuel flowing toward the loading chamber 71 is forced to flow through the return line 75 to the tank 29, so that the adjusting piston 67, of the adjusting member 69 which is subjected to the force of the pressure spring 31, assumes the shown position, in which a control edge 79*a*, which is formed by the frontal surface 79 of the adjusting piston 67 which faces the piston chamber 72, cooperates with an annular groove 81, which serves as an opening position for the return line 75, and is located in the wall of the cylindrical bore 66. In this position the adjusting member 69 forms a hydraulically limited stop for a lower delivery rate or full-load position of the regulating rod of the fuel injection pump 10.

After the lock nut 64 is released, the cylindrical bushing 63 can be moved inside the housing 62 for adjusting this full-load or lower delivery rate position of the adjusting member 69 as shown in FIG. 5.

In the suction chamber 22 of the fuel injection pump 10, in the same manner as in the previous exemplary embodiments, the fuel is supplied by means of delivery pump 46, which is driven simultaneously with the injection pump 10. The delivery pump 46 is equipped with a pressure limiting valve 82 so as to limit the pressure that appears in the suction chamber 22. Both magnetic valves 23" and 77 are shown only with their circuitry symbols in the drawing, and can, of course, be mounted inside the housing 62 of the control device 61 when the structure is built. There is also the additional possibility of incorporating this valve into any desired position in the lines 27 or 75.

Figure 6:
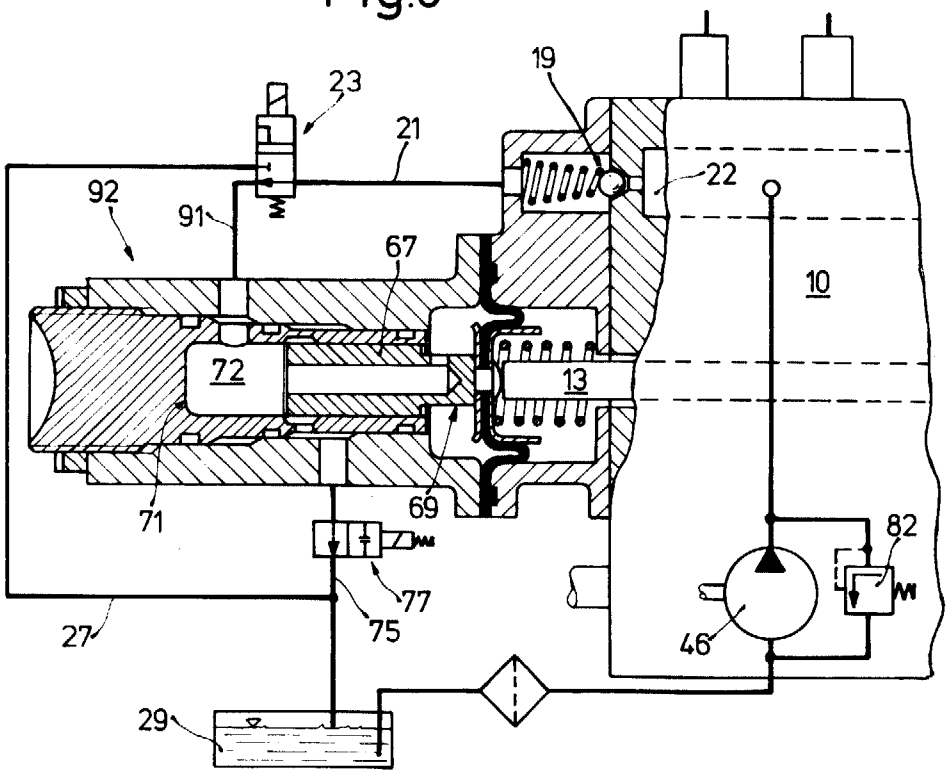
FIG. 6 shows a longitudinal sectional view through a fourth exemplary embodiment that includes a modification incorporating a 3/2 way valve.

The fourth exemplary embodiment of the invention is shown only fragmentarily in FIG. 6 and is only slightly different from the third exemplary embodiment of the invention shown in FIG. 5. Thus, in addition to the return line 75, which is controlled by the second magnetic valve 77, only a control line 91, which serves both the entry and discharge of the fuel that flows through the feed line 21 out of the suction chamber 22 of the injection pump 10, is connected to the piston chamber 72 of the loading chamber 71. This line 91 can be connected with the discharge line 27 leading to the tank 29 and with the control line 21 by the magnetic valve 23, which is formed as a 3/2 way valve, in its single non-effective position, and only with the feed line 21, which is fed by the delivery pump 46, in its other position shown in FIG. 6, so that in the one non-effective position the pressure chamber 72 and thereby the entire loading chamber 71 is relieved of pressure, and the fuel coming from the suction chamber 22 and through the discharge valve 19 can be emitted. Because the delivery pump 46 is provided with a pressure limiting valve 82, the connection of the control line 91 to the feed line 21 could also be blocked when the control line 91 is connected with the discharge line 27. If the control line 91 is connected to the feed line 21 in front of the magnetic valve 22 (seen from the flow direction), then the magnetic valve 23 can be designed like the magnetic valve 77 as a 2/2 way valve, but would still operate like the 3/2 way valve that is shown in FIG. 6.

In the following the method of operation of the above described exemplary embodiments is described:

In the first exemplary embodiment of the invention shown in FIG. 1, when both electromagnets 25 and 42 are not activated the fuel injection pump 10 stands still, the suction chamber 22 has no pressure, and the fuel in the loading chamber 18 of the adjusting piston 16, which could possibly still be somewhat pressurized, has been automatically relieved by means of a drainage area, which leads to the discharge line 27, and is present because of the play in the slide valve 24. Thus, at this time the adjusting piston 16 has been moved into the position shown by the pressure spring 31 and in which position the frontal surface 34 of the adjusting member 17 forms a stop for the maximum possible position of the regulating rod 13. In this position either the full-load delivery rate or an increased quantity necessary for starting of the engine can be delivered by the fuel injection pump 10. When the electromagnet 25 of the magnetic valve 23, which may also be designated as the starting magnet, is activated, the slide valve 24 moves downward against the force of the return spring 26, thus opening the connection from the loading chamber 18 through the annular groove 28 to the feed line 27, so that the fuel flowing from the suction chamber 22 when the pump is running can immediately flow back into the tank 29, and also the fuel that may possibly be remaining in the loading chamber 18 could also flow out.

During operation of the vehicle the magnet 25 of the magnetic valve 23 remains subjected to current, and the adjusting member 17 remains in its position shown in the drawing, but the governor 9 draws the regulating rod 13 back from the position shown into a full-load position, (not shown) which is determined by a stop means provided inside the governor 9, all of which will be understood by those skilled in this art.

When the engine is turned off, the supply of current to the electromagnets 25 is interrupted and the slide valve 24 of the magnetic valve 23 returns to its position shown in FIG. 1, thus, the outflow line 27 is blocked and the loading chamber 18 is placed under pressure. Also, the adjusting member 17, which is provided with the adjusting piston 16, moves against the force of the spring 31 (toward the right as seen in the drawing) and presses the regulating rod 13 of the injection pump 10 into its zero or stop position, in which the injection pump 10 no longer delivers any fuel, therefore shutting off the internal combustion engine.

The aforementioned interruption to operation is also begun when the supply of current to the electromagnet 25 is unintentionally interrupted by a malfunction in the electrical system.

If during operation of the engine, when the electromagnet 25 is engaged, a reduced full-load position of the regulating rod 13 is desired, then the position of the adjusting member 17, which serves as a stop, said position also being designated as the lower delivery rate position, can also be introduced since the electromagnet 25 is disengaged and the electromagnet 42 is engaged. The electromagnet 42 then moves the stop slide 41 into the recess 44 of the adjusting piston 16 and the shut-off movement of the adjusting piston 16, which is begun when the electromagnet 25 is disengaged, is limited because the stop edge 45 comes to rest on the stop slide 41, which is moved against the force of the spring 43. In this manner an arbitrarily activatable lower delivery rate position of the regulating rod 13 can be set. If the electromagnet 42 fails because of a malfunction in the electrical system, the above-described shut-off movement of the adjusting piston 16 takes place and the engine stops.

This control device 11 also functions as a security measure against theft of the motor vehicle, because when the electrical system is not engaged the control device 11 moves the regulating rod 13 immediately in the stop direction after the vehicle has stopped.

The control device 11' of the second exemplary embodiment shown in the FIGS. 2 through 4 operates in the same manner as the control device 11 that is shown in FIG. 1. Only the control slide 24' is also provided with a security and overflow valve 52, which should prevent an overload of the adjusting piston 16'. This type of valve is principally necessary when the delivery pump of the injection pump 10 does not have its own pressure limiting valve. Because the adjusting piston 16 of FIG. 2, i.e. 16', which may be designated as a de-adjusting piston, serves as a lower delivery rate stop by means of its cooperation with the control slide 41 of the second electromagnet 42, the result is a very compact and space-saving construction of the control device. In FIG. 3 the control slide 41 is shown in the position which it assumes to limit the lower delivery rate position when the electromagnet 42 is activated.

In the third exemplary embodiment according to FIG. 5, in contrast to the previously described exemplary embodiments, the position of the adjusting member 69, which serves as the lower delivery rate stop, is hydraulically controlled. This position is also shown in FIG. 5, in which the magnetic valve 23'' is in its disengaged position, where it blocks the discharge of the fuel from the loading chamber 71 to the discharge line 27, and the second magnetic valve 77 is shown in the position in which the valve member 78 holds open the flow cross section of the return line 75 when the magnet 76 is engaged. The fuel that flows past the control point, which is formed by the annular groove 81 and the control edge **79*a*, holds the adjusting piston 67 and thereby the adjusting member 69 in its position where it determines the lower delivery rate position of the regulating rod 13 of the fuel injection pump 10. If the magnet 76 of the magnetic valve 77 is disengaged, then the return line 75 is blocked and the adjusting member 69 moves farther in the stop direction and thus also moves the regulating rod 13** into its stop position.

During starting and operation of the internal combustion engine, the magnetic valve 77 remains disengaged and the magnetic valve 23'' is engaged, thus arriving in its other position, where it connects the outflow line 27 with the loading chamber 71. The aforesaid position is additionally shown in the switch symbol of the magnetic valve 23''.

The fourth exemplary embodiment shown in FIG. 6 is illustrated in the same operational position, which determines the lower delivery rate position of the regulating rod 13, as that shown in FIG. 5, in which the second magnetic valve 77 holds the return line 75 open and the first magnetic valve 23 blocks the connection from the loading chamber 71 to the discharge line 27. The placement of the corresponding lines, which deviates from that in FIG. 5, and the embodiment of the first magnetic valve 23 was described earlier herein.

In all four shown exemplary embodiments the fuel flowing out of the suction chamber 22 of the fuel injection pump 10 to the tank 29 serves as the hydraulic medium for the control device according to the invention. Of course, all variations of the embodiments can be driven with the lubricating oil of the engine or with pressurized oil from a separate pressure source. The adjusting diaphragm used in the embodiments according to FIGS. 5 and 6 can also be used in combination with the adjusting piston 16 of FIG. 1, or 16' of the structure shown in FIGS. 2 through 4, should this be advantageous because of the required forces, or because a better seal toward the pump is desired.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A control device for a diesel-injection internal combustion engine, provided with a magnetic valve adapted to determine the zero position of the delivery rate adjusting member of an injection pump, as well as to block the discharge of a hydraulic medium from a loading chamber of an adjusting member to an unpressurized chamber by means of a valve member that can be activated by a first electromagnet, said hydraulic medium being subject to the delivery pump pressure and capable of moving said adjusting member, further characterized wherein a second electromagnet includes a control member adapted to limit movement of the adjusting member, said adjusting member also being under the control of said valve member and capable of limiting movement of said adjusting member to a position which controls the delivery rate of said adjusting member of said injection pump and functions as a delivery rate stop therefor.

2. A control device according to claim 1, further wherein said control member of said second electromagnet cooperates with an adjusting piston, said adjusting piston further including a stop means arranged for engagement with said control member when said second electromagnet is engaged.

3. A control device according to claim 2, further wherein said control member engages in a longitudinally extending flat groove portion provided in the recess of said adjusting member and arranged to extend toward said loading chamber even when said second magnet is disengaged.

4. A control device according to claim 2, wherein said adjusting piston further includes an adjustable stop means that includes a portion that terminates in said loading chamber.

5. A control device according to claim 4, wherein said adjustable stop means further includes at its opposite end portion a support means for a pressure spring means.

6. A control device according to claim 4, wherein said adjustable stop means is threaded into said adjusting piston and secured by a lock nut means.

7. A control device according to claim 6, wherein the terminal portion of said stop means includes a movement limiting means therefor and said support means on said stop means forms a travel limiting means for said pressure spring means.

8. A control device according to claim 1, wherein the valve member of said magnetic valve is formed as a slide valve that includes an axial bore arranged to contain a spring loaded overflow valve means adapted to provide for communication between a return line and a feed line of said injection pump leading to the loading chamber.

9. A control device according to claim 1, wherein said device includes an adjusting piston and a further valve member serves as the control member of a second magnetic valve that is associated with said second electromagnet, said last named valve member being operated by said second electromagnet arranged to control the flow cross section of a return line.

10. A control device according to claim 9, wherein said adjusting piston includes a control edge and said return line communicates with an annular groove so that said loading chamber is adjustable to determine the delivery rate position of said adjusting member.

11. A control device according to claim 10, wherein said loading chamber is formed by a bore in a longitudinally adjustable cylinderical bushing disposed in a housing.

12. A control device according to claim 11, wherein said bushing includes a portion that extends out of said housing, said portion being adapted to be adjusted relative to said housing and secured against inadvertent movement.

13. A control device according to claim 12, wherein said adjusting piston is provided with a flexible diaphragm that is also subjected to the pressure in said loading chamber.

14. A control device according to claim 8, wherein said return line is controlled by said second magnetic valve.

15. A control device according to claim 14, wherein a control line is connected to said loading chamber and said first magnetic valve is formed as a 3/2 way valve which in one position is connected with a further return line that leads to an unpressurized chamber and in another position is connected with said feed line which is supplied from said delivery pump.

* * * * *